US011412599B2

(12) United States Patent
Van De Sluis et al.

(10) Patent No.: US 11,412,599 B2
(45) Date of Patent: Aug. 9, 2022

(54) TRANSMITTING SENSOR SIGNAL IN DEPENDENCE ON DEVICE ORIENTATION

(71) Applicant: SIGNIFY HOLDING B.V., Eindhoven (NL)

(72) Inventors: Bartel Marinus Van De Sluis, Eindhoven (NL); Ekhtiar Syed, Eindhoven (NL); Remco Magielse, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/270,959

(22) PCT Filed: Aug. 13, 2019

(86) PCT No.: PCT/EP2019/071752

§ 371 (c)(1),
(2) Date: Feb. 24, 2021

(87) PCT Pub. No.: WO2020/038783

PCT Pub. Date: Feb. 27, 2020

(65) Prior Publication Data

US 2021/0329765 A1 Oct. 21, 2021

(30) Foreign Application Priority Data

Aug. 24, 2018 (EP) ..... 18190663

(51) Int. Cl.

| | |
|---|---|
| ***H05B 47/115*** | (2020.01) |
| ***H05B 47/19*** | (2020.01) |
| ***F21V 23/04*** | (2006.01) |

(52) U.S. Cl.
CPC ..... *H05B 47/115* (2020.01); *H05B 47/19* (2020.01); *F21V 23/0492* (2013.01)

(58) Field of Classification Search
CPC .... H05B 47/19; H05B 47/115; F21V 23/0492
See application file for complete search history.

(56) References Cited

U.S. PATENT DOCUMENTS

2009/0179586 A1 7/2009 Cortenraad et al.
2013/0111370 A1* 5/2013 Pasquero ..... G06F 3/1423 715/761

(Continued)

FOREIGN PATENT DOCUMENTS

DE 102016200310 A1 * 7/2017
WO 2016155950 A1 10/2016
WO 2017078604 A1 5/2017

*Primary Examiner* — Raymond R Chai

(57) ABSTRACT

An electronic device, e.g. a sensor device (41), is configured to receive a sensor signal from an electromagnetic radiation sensor (43), determine an orientation of the electromagnetic radiation sensor (43) based on said sensor signal or based on an orientation signal received from an orientation sensor (4) comprised in said electromagnetic radiation sensor, and transmit the sensor signal to one of a plurality of devices or applications in dependence on the determined orientation. The plurality of devices or applications comprises a first device or application, e.g. a light control device or application, and a second device or application, e.g. a security device or application. The plurality of devices or applications may also comprise a third device or application, e.g. a people counting device or application.

12 Claims, 3 Drawing Sheets

(56) References Cited

U.S. PATENT DOCUMENTS

| | | | | |
|---|---|---|---|---|
| 2015/0145419 | A1 | 5/2015 | Lashina et al. | |
| 2015/0173154 | A1* | 6/2015 | Faulkner | H05B 47/11 315/76 |
| 2015/0316250 | A1* | 11/2015 | Mangrum, Jr. | F21V 33/004 362/101 |
| 2016/0007431 | A1 | 1/2016 | Bosua et al. | |
| 2016/0345406 | A1 | 11/2016 | Donhowe et al. | |
| 2017/0094752 | A1 | 3/2017 | Chen | |
| 2017/0278383 | A1 | 9/2017 | Dimberg et al. | |
| 2018/0153023 | A1 | 5/2018 | Meerbeek et al. | |
| 2018/0332689 | A1* | 11/2018 | Clout | H05B 47/18 |

* cited by examiner

TRANSMITTING SENSOR SIGNAL IN DEPENDENCE ON DEVICE ORIENTATION

CROSS-REFERENCE TO PRIOR APPLICATIONS

This application is the U.S. National Phase application under 35 U.S.C. §371 of International Application No. PCT/EP2019/071752, filed on Aug. 13, 2019, which claims the benefit of European Patent Application No. 18190663.7, filed on Aug. 24, 2018. These applications are hereby incorporated by reference herein.

FIELD OF THE INVENTION

The invention relates to an electronic device for transmitting a sensor signal

The invention further relates to a method of transmitting a sensor signal.

The invention also relates to a computer program product enabling a computer system to perform such a method.

BACKGROUND OF THE INVENTION

More and more sensor devices are being used as part of lighting systems, as they enable automatically switching the light to a desired setting based on a detected input. Sensor devices are getting more advanced, often combining multiple sensor modalities. For example, the Philips Hue Motion Sensor comprises an integrated light sensor, temperature and PIR sensor. This enables the implementation of smarter functions.

A sensor device that combines multiple modalities is also disclosed in US 2016/0345406 A1. The path light control device disclosed in the patent document can include a processor, light source and any combination of ambient light sensors, passive infrared sensors, accelerometers and compass sensors. In one embodiment, the orientation of the sensor is determined, a degree of sensor function in such orientation is determined and sensor operation is disabled when the detected orientation indicates the data of the sensor is not applicable for proper device control.

Sensor devices are not only used as part of lighting systems, but also for other applications, e.g. security. Each application typically uses its own sensor devices. This results in many sensor devices being installed in homes and offices, which increases power consumption and decreases the buildings' aesthetics.

SUMMARY OF THE INVENTION

It is a first object of the invention to provide an electronic device, which can be used to reduce the number of sensor devices that is needed for a certain set of applications.

It is a second object of the invention to provide a method of transmitting a sensor signal, which can be used to reduce the number of sensor devices that is needed for a certain set of applications.

In a first aspect of the invention, the electronic device comprises at least one processor configured to receive a sensor signal from an electromagnetic radiation sensor, determine an orientation of said electromagnetic radiation sensor based on said sensor signal or based on an orientation signal received from an orientation sensor comprised in said electromagnetic radiation sensor, and if said electromagnetic sensor is oriented in a first orientation, transmit said sensor signal to a first device or application of a plurality of devices or applications, and if said electromagnetic sensor is oriented in a second orientation, transmit said sensor signal to a second device or application of said plurality of devices or applications. Said first device or application may be a lighting control device or application and said second device or application may be a device or application different from a lighting control device or application, for example.

The inventors have recognized that it is beneficial to allow a single electromagnetic radiation sensor to be used for multiple applications and that rotating a sensor device comprising the sensor (and thereby rotating the sensor itself) is a very intuitive way of switching between applications. The different applications may run on a single device or on a plurality of devices. The sensor signal is transmitted to one of the plurality of devices or applications in dependence on the orientation of the sensor. The orientation of the electromagnetic radiation sensor may be determined by a component that has the same orientation as this sensor. If the electromagnetic radiation sensor is not able to move (e.g. rotate) within the device in which it is incorporated, then the orientation of this sensor is the same as the orientation of this device.

Said first device or application may be a node in a lighting network and said second device or application may be configured to render on-screen information in dependence on said sensor signal. For example, said first device or application may be configured to control a light, e.g. turn on and/or off the light, in dependence on the sensor signal. Said second device or application may be configured to perform sleep monitoring, baby monitoring, security monitoring, people counting, pet monitoring, and/or health monitoring, for example. Rendering of on-screen information is beneficial for many applications other than light control applications and some of these other applications may also be able to advantageously benefit from sensor input.

Said second device or application may be configured to cause a speaker and/or a display to render textual information. Rendering of textual information is beneficial for many applications other than light control applications and some of these other applications may also be able to advantageously benefit from sensor input. The textual information may comprise an alert that motion or a person has been detected (e.g. for security monitoring) or that sound has been detected (e.g. for security or baby monitoring) or information on sleep states, for example. Textual information may be rendered via the speaker by using voice synthesis or by using a set of recorded voice messages, for example. The speaker and/or the display me be part of the second device or part of a different device.

Said at least one processor may be configured to determine a user identity and transmit said sensor signal to one of said plurality of devices or applications further in dependence on said user identity. This allows different sensor modes to be configured for different users. For example, one user may want to use a lighting control application and a baby monitoring application, while another user may want to use a lighting control application and a security monitoring application.

Said at least one processor may be configured to determine said orientation from an orientation signal received from an orientation sensor in a device which further comprises said electromagnetic radiation sensor, e.g. a sensor device. The use of a separate orientation sensor is especially beneficial for certain types of electromagnetic radiation sensors, e.g. an RF sensor or a microwave senor.

Said at least one processor may be configured to determine said orientation from said sensor signal. If the electromagnetic radiation sensor is a camera, for example, then a separate orientation sensor may not be necessary.

Said electronic device may comprise said electromagnetic radiation sensor. In other words, said electronic device may be a sensor device. Implementing the invention in a sensor device allows the invention to be used with lighting systems that do not use a bridge, for example. A bridge is a central hub acting as a bridge between user devices and lights.

Said electronic device may have a plurality of support surfaces, said orientation indicating on which of said plurality of support surfaces said sensor device is resting.

Said at least one processor may be configured to receive said sensor signal from a sensor device. Implementing the invention in a bridge instead of in the sensor device allows the sensor device to be simpler.

In a second aspect of the invention, a system comprises such an electronic device, e.g. a bridge, and a sensor device with a plurality of support surfaces, said orientation indicating on which of said plurality of support surfaces said sensor device is resting. It is typically easiest to distinguish between different orientations if the sensor device has different support surfaces. Since there is normally no doubt about the support surface on which the sensor device is resting, there is normally no doubt about the orientation of the sensor device in this case.

In a third aspect of the invention, the method comprises receiving a sensor signal from an electromagnetic radiation sensor, determining an orientation of said electromagnetic radiation sensor based on said sensor signal or based on an orientation signal received from an orientation sensor comprised in said electromagnetic radiation sensor, and if said electromagnetic sensor is oriented in a first orientation, transmitting said sensor signal to a first device or application of a plurality of devices or applications, and if said electromagnetic sensor is oriented in a second orientation, transmitting said sensor signal to a second device or application of said plurality of devices or applications. Said method may be performed by software running on a programmable device. This software may be provided as a computer program product. Moreover, a computer program for carrying out the methods described herein, as well as a non-transitory computer readable storage-medium storing the computer program are provided. A computer program may, for example, be downloaded by or uploaded to an existing device or be stored upon manufacturing of these systems.

A non-transitory computer-readable storage medium stores at least one software code portion, the software code portion, when executed or processed by a computer, being configured to perform executable operations comprising: receiving a sensor signal from an electromagnetic radiation sensor, determining an orientation of said electromagnetic radiation sensor, and transmitting said sensor signal to one of a plurality of devices or applications in dependence on said determined orientation, said plurality of devices or applications comprising a first device or application and a second device or application.

As will be appreciated by one skilled in the art, aspects of the present invention may be embodied as a device, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

BRIEF DESCRIPTION OF THE DRAWINGS

These and other aspects of the invention are apparent from and will be further elucidated, by way of example, with reference to the drawings, in which.

Corresponding elements in the drawings are denoted by the same reference numeral.

DETAILED DESCRIPTION OF THE EMBODIMENTS

Figure 1:
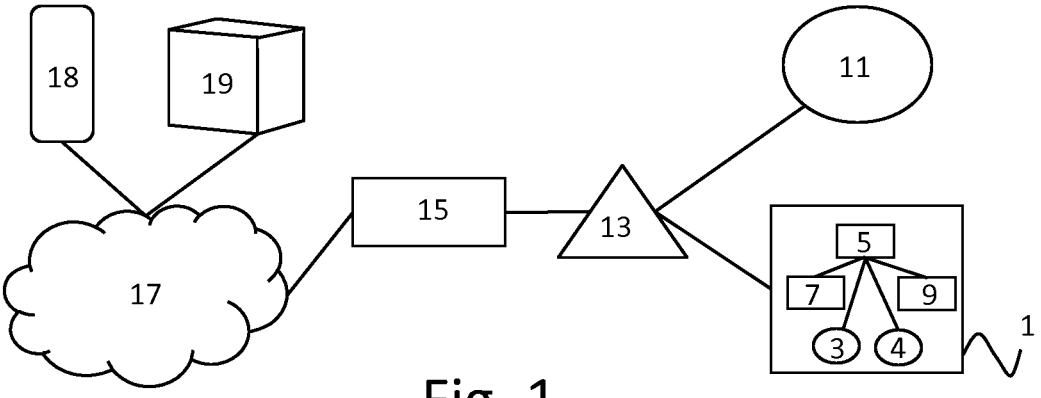
FIG. 1 is a block diagram of a first embodiment of the electronic device of the invention in which the electronic device is a sensor device.

FIG. 1 shows a first embodiment of the electronic device of the invention: a sensor device 1. The sensor device 1 communicates with/via a bridge 13, e.g. via Zigbee. A light device 11 also communication with/via the bridge 13, e.g. via Zigbee. The bridge 13 may be a Philips Hue bridge and the light 11 may be a Philips Hue light, for example. The bridge 13 is connected to a wireless LAN access point 15, e.g. via Ethernet. The wireless LAN access point 15 is connected to the Internet 17. A mobile device 18 and an Internet server 19 are also connected to the Internet 17.

The sensor device 1 comprises a processor 5, a transceiver 7, a memory 9, an electromagnetic radiation sensor 3 and an orientation sensor 4. The processor 5 is configured to receive a sensor signal from the electromagnetic radiation sensor 3, determine an orientation of the electromagnetic radiation sensor 3, and transmit the sensor signal to one of a plurality of devices or applications in dependence on the determined orientation. The processor is configured to, if said electromagnetic sensor is oriented in a first orientation, transmit said sensor signal to a first device or application, and, if said electromagnetic sensor is oriented in a second orientation, transmit said sensor signal to a second device or application. In the embodiment of FIG. 1, the processor 5 is configured to determine the orientation from an orientation signal received from the orientation sensor 4. The electromagnetic radiation sensor 3 may comprise a PIR sensor, a camera, an RF sensor and/or a microwave senor, for example. The orientation sensor 4 may, for example, comprise an accelerometer or may comprise multiple light sensors, e.g. on difference surfaces of the sensor device 1 for detecting on which of these surfaces the sensor device 1 is resting.

The plurality of devices or applications comprises a first device or application and a second device or application. In the example of FIG. 1, the first device or application is a lighting control device or application, namely a bridge 13, and the second device or application is a device or application different from a lighting control device or application. The bridge 13 is configured to cause a light to turn on in dependence on the sensor signal and the second device or application is configured to render textual information in dependence on the sensor signal.

In the example of FIG. 1, the Internet server 19 offers a plurality of applications in the cloud, including security monitoring and people counting. In dependence on the orientation determined orientation, the sensor signal is transmitted to the bridge 13, to the security monitor application on the Internet server 19 or to the people counting application on the Internet server 19. The Internet server 19 may comprise a single device or plurality of devices.

The security monitoring and people counting applications, and thus the Internet server 19 on which they are running, are configured to cause a speaker and/or a display of the mobile device 18 to render the textual information, e.g. by transmitting a chat message to the mobile device 18 or by transmitting data to an app running on the mobile device 18, which forms the client part of the application. The textual information may comprise an alert that motion or a person has been detected or the number of persons that have been counted, for example. In addition to or instead of for a security monitoring application and/or for a people counting application, the sensor device 1 may be used for a sleep monitoring application and/or a baby monitoring application.

In the embodiment of the sensor device 1 shown in FIG. 1, the sensor device 1 comprises one processor 5. In an alternative embodiment, the sensor device 1 comprises multiple processors. The processor 5 of the sensor device 1 may be a general-purpose processor or an application-specific processor. The processor 5 of the sensor device 1 may or may not run an operating system. The memory 9 may comprise one or more memory units. The memory 9 may comprise solid-state memory, for example. The memory 9 may be used to store associations between orientations and device or application addresses, for example.

In the embodiment shown in FIG. 1, a receiver and a transmitter have been combined into a transceiver 7. In an alternative embodiment, one or more separate receiver components and one or more separate transmitter components are used. In an alternative embodiment, multiple transceivers are used instead of a single transceiver. The transceiver 7 may use one or more wireless communication technologies to communicate with bridge 13, e.g. Zigbee. In an alternative embodiment, the sensor device 1 only comprises a transmitter. The sensor device 1 may comprise other components typical for a sensor device such as a power connector or a battery. A battery makes the sensor device 1 especially portable.

Figure 2:
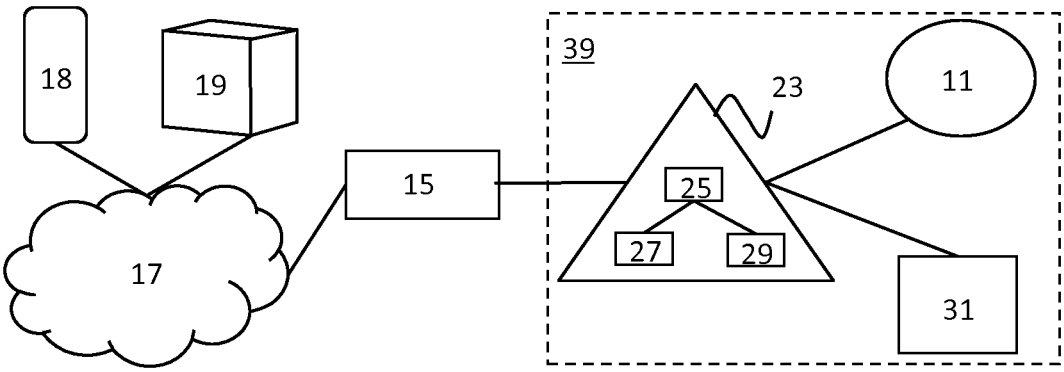
FIG. 2 is a block diagram of an embodiment of the system of the invention including a second embodiment of the electronic device of the invention in which the electronic device is a bridge.

FIG. 2 shows a second embodiment of the electronic device of the invention: a bridge 23, e.g. a Philips Hue bridge. The bridge 23 comprises a processor 25, a transceiver 27, and a memory 29. The processor 25 is configured to receive a sensor signal from an electromagnetic radiation sensor, determine an orientation of the electromagnetic radiation sensor, and transmit the sensor signal to one of a plurality of devices or applications in dependence on the determined orientation.

In the embodiment of FIG. 2, the processor 25 is configured to receive the sensor signal from a sensor device 31, which comprises the electromagnetic radiation sensor, and determine the orientation from an orientation signal received from an orientation sensor in the sensor device 31. In an alternative embodiment, the processor 25 is configured to determine the orientation from the sensor signal. For example, if the electromagnetic radiation sensor is a camera, the processor 25 may be configured to determine its orientation from the orientation of objects, e.g. doors, in images captured by the camera.

The plurality of devices or applications comprises a first device or application and a second device or application. In the example of FIG. 2, the first device or application is a lighting control device or application, namely the light device 11, and the second device or application is a device or application different from a lighting control device or application. The light device 11 comprises a light source and circuitry configured to cause the light source to turn on in dependence on the sensor signal and the second device or application is configured to render textual information in dependence on the sensor signal, as described in relation to FIG. 1.

FIG. 2 also shows an embodiment of the system of the invention: system 39. The system comprises the bridge 23 and the sensor device 31. In the embodiment of FIG. 2, the system 39 also comprises the light device 11.

In the embodiment of the bridge 23 shown in FIG. 2, the bridge 23 comprises one processor 25. In an alternative embodiment, the bridge 23 comprises multiple processors. The processor 25 of the bridge 23 may be a general-purpose processor, e.g. ARM-based, or an application-specific processor. The processor 25 of the bridge 23 may run a Unix-based operating system for example. The memory 29 may comprise one or more memory units. The memory 29 may comprise one or more hard disks and/or solid-state memory, for example. The memory 29 may be used to store a table of connected lights, for example. The memory 29 may be used to store associations between orientations and device or application addresses, for example.

The transceiver 27 may use one or more communication technologies to communicate with the wireless LAN access point 15, e.g. Ethernet. In an alternative embodiment, multiple transceivers are used instead of a single transceiver. In the embodiment shown in FIG. 2, a receiver and a transmitter have been combined into a transceiver 27. In an alternative embodiment, one or more separate receiver components and one or more separate transmitter components are used. The bridge 23 may comprise other components typical for a network device such as a power connector. The invention may be implemented using a computer program running on one or more processors.

In a different embodiment, the processor 5 or the processor 25 is configured to determine a user identity and transmit the sensor signal to one of the plurality of devices or applications further in dependence on the user identity. For example, a first orientation of the sensor may be associated with a lighting control device or application for all users, while a second orientation of the sensor may be associated with a security device or application for one user and with a baby monitoring device or application for another user.

Figure 3:
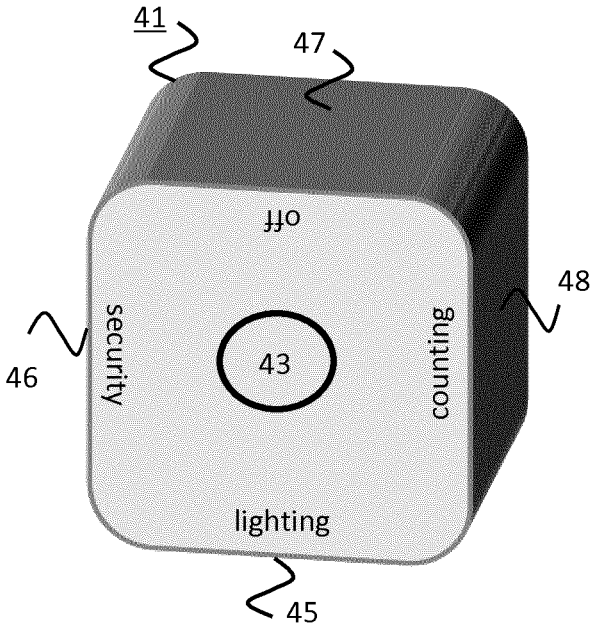
FIG. 3 shows a further embodiment of a sensor device.

The sensor device 1, the sensor device 31 or another sensor device for use with the invention may have a plurality of support surfaces. This is shown in FIG. 3 for sensor device 41. The sensor device 41 has six surfaces and is intended to rest on one of the support surfaces 45-48. The orientation of the sensor device 41 indicates on which of the plurality of support surfaces the sensor device 41 is resting. The electromagnetic radiation sensor 43 is positioned in the center of the front surface of the sensor device 41.

When the sensor device 41 rests on the front surface, the sensor 43 is obstructed and cannot be used. In the embodiment of FIG. 3, the sensor device 41 can be turned off by resting the sensor device 41 on the third support surface 47, which results in a third orientation. In an alternative embodiment, the sensor device can be switched off by resting the sensor device on the front surface. Since the electromagnetic radiation sensor 43 is positioned in the center of the front surface of the sensor device 41, the sensor device 41 can rest on any of the support surfaces 45-48 without impacting the functioning of the sensor 43 and its field of view, if the sensor 43 has a symmetrical viewing angle. When the sensor device 41 rests on the back surface, the sensor 43 points upwards, which makes the sensor 43 less useful.

In the embodiment of FIG. 3, a lighting control device or application is selected when the sensor device 41 is placed on the first support surface 45, a security device or application is selected when the sensor device 41 is placed on the second support surface 46 and a people counting device or application is selected when the sensor device 41 is placed on the fourth support surface 48. Where the sensor signal is transmitted by the sensor device 41 in dependence on the determined orientation may be pre-configured in the sensor device 41 or may be remotely configurable, e.g. using a mobile device.

Figure 4:
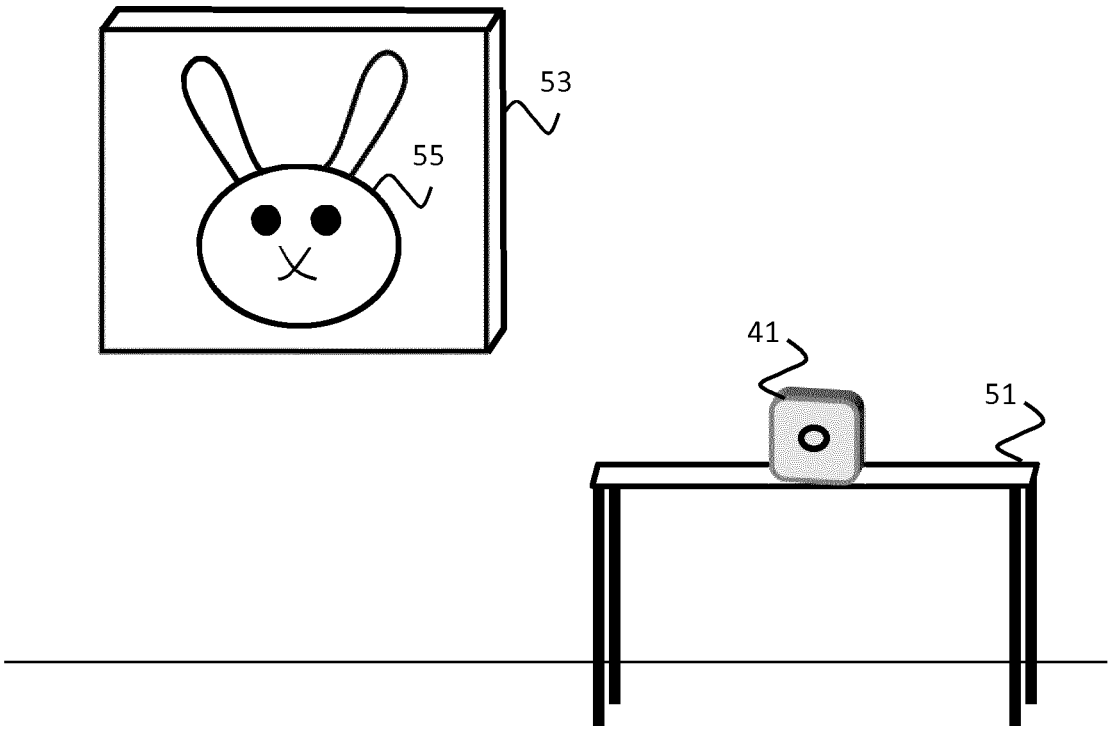
FIG. 4 depicts an example of an environment in which the sensor device of FIG. 3 may be used.

FIG. 4 depicts an example of an environment in which the sensor device 41 may be used. In this example, the sensor device 41 has been put on a table 51. The sensor device 43 may transmit the sensor signal continuously or only when motion is detected. If the invention is implemented in the bridge 23 of FIG. 2, the sensor signal from the sensor 43 is transmitted to the bridge 23 independent of the orientation of the sensor 43.

The bridge 23 transmits the sensor signal to a light device 53 if the orientation of the sensor 43 is the first orientation. The light device 53 determines from the sensor signal if a person has been detected and turns the light source 55 on if a person has been detected. The bridge 23 transmits the sensor signal to a security application on the Internet server 19 if the orientation of the sensor 43 is the second orientation and to a people counting application on the Internet server 19 if the orientation of the sensor 43 is the fourth orientation. The bridge 23 may determine the orientation from the sensor signal or from an orientation signal received from the sensor device 41.

If the invention is implemented in the sensor device 41, the sensor device 41 transmits the sensor signal from the sensor 43 to the bridge 13 of FIG. 1 if the orientation of the sensor 43 is the first orientation. The bridge 13 then commands the light device 53 to turn the light source 55 on if the sensor signal indicates that a person's presence has been detected. The sensor device 41 transmits the sensor signal to a security application on the Internet server 19 if the orientation of the sensor 43 is the second orientation and to a people counting application on the Internet server 19 if the orientation of the sensor 43 is the fourth orientation.

In the example of FIGS. 3 and 4, three sensor modes (orientations) have been configured: lighting control, security, and people counting. Other sensors modes may be configured instead of or in addition to one or more of these three sensor modes. These sensor modes may be preconfigured or may be remotely configurable, for example. Although at least two of the sensor modes result in sensor data being transmitted to different devices or applications, there may also be sensor modes which result in sensor data being transmitted to the same device or application, but further result in the device or application behaving differently and/or further result in the sensor device itself behaving differently.

For instance, the following behavior may depend on the orientation:

what events or objects are detected (e.g. human presence, motion, people identification, activity)

what sensors are active (e.g. PIR only, PIR+microphone, PIR+camera etc.)

what actions are associated with the detected sensor events (e.g. light on, or light+music on)

what response the system should give/what mode the system should be set to (e.g., activating a scene, activating presence mimicking, sending a push notification to the user)

motion sensitivity (e.g. various orientations associated with various sensitivity settings)

time-out functions (e.g. switch off after no motion for 5 minutes or 15 minutes)

As a first example, different modes may be configured for day and night. The Philips Hue system currently offers the opportunity for the user to set up a day and night mode in which day behavior or night behavior is selected automatically based on time. However, since the user may not always go to bed at the same time, nor wake up at the same time, it would require endless adjustment of these times to fit the schedule of the user, or it can lead to frustration. By assigning one side of the sensor device to the 'day' behavior and the other side of the sensor device to the 'night' behavior, the user remains in control of what behavior is active and can easily switch. Furthermore, this could be taken as input for other components in the system as well. If the user rotates the sensor device to the night mode this could for instance directly activate 'go to sleep' settings and dim the lights down gradually over time. Additionally, when the user rotates back to the 'day' mode, this may activate wake up settings and for example switch on energizing light in the bathroom.

As a second example, the behavior in a living room may be adjusted in similar manner. One side of the sensor device could be associated with a 'functional' light mode for use during the day and another side of the sensor device could be associated with a 'decorative' light mode for during the evening. In the functional light mode, the light is bright and quickly responds to the user's motion. In the decorative light mode, the light contains more colors and it may take longer for the sensor to switch lights off, or the lights may not even switch off at all.

Figure 5:
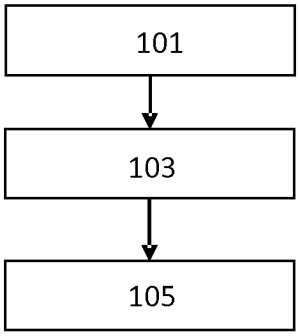
FIG. 5 is a flow diagram of an embodiment of the method of the invention.

A first embodiment of the method of the invention is shown in FIG. 5. A step 101 comprises receiving a sensor signal from an electromagnetic radiation sensor. A step 103 comprises determining an orientation of the electromagnetic radiation sensor. A step 105 comprises transmitting the sensor signal to one of a plurality of devices or applications in dependence on the determined orientation. The plurality of devices or applications comprises a first device or application and a second device or application.

Figure 6:
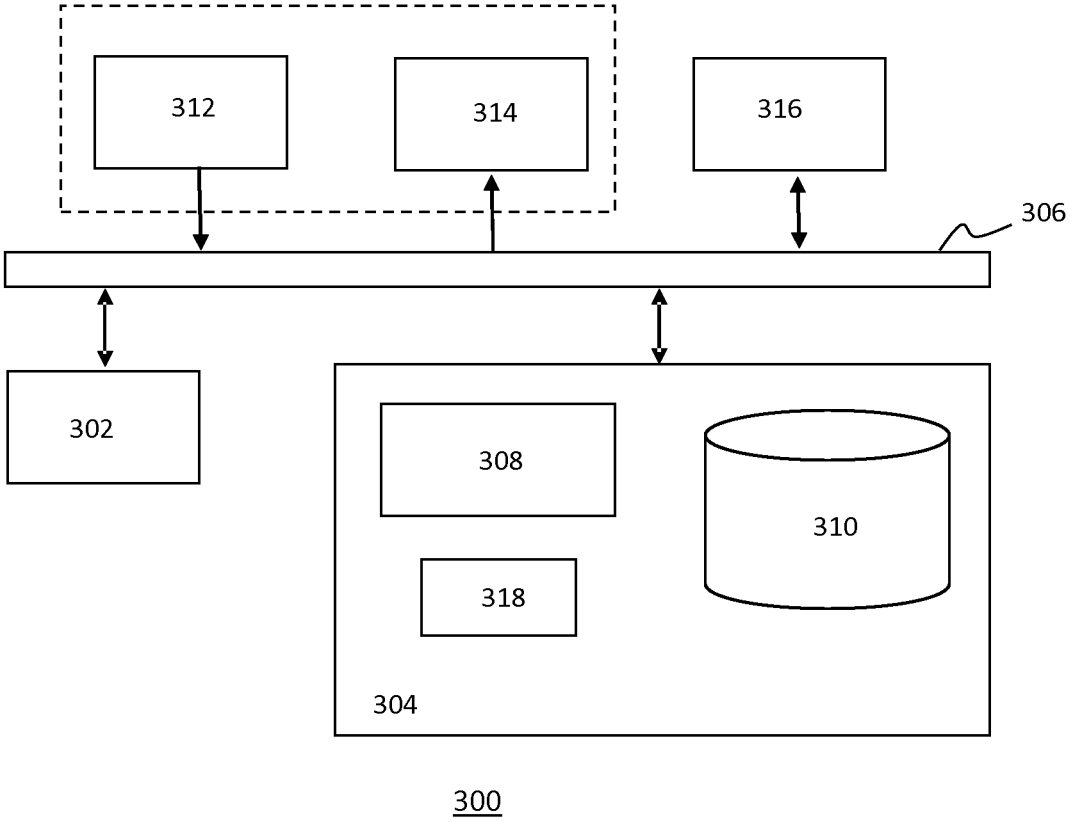
FIG. 6 is a block diagram of an exemplary data processing system for performing the method of the invention.

FIG. 6 depicts a block diagram illustrating an exemplary data processing system that may perform the method as described with reference to FIG. 5.

As shown in FIG. 6, the data processing system 300 may include at least one processor 302 coupled to memory elements 304 through a system bus 306. As such, the data processing system may store program code within memory elements 304. Further, the processor 302 may execute the program code accessed from the memory elements 304 via a system bus 306. In one aspect, the data processing system may be implemented as a computer that is suitable for storing and/or executing program code. It should be appreciated, however, that the data processing system 300 may be implemented in the form of any system including a processor and a memory that is capable of performing the functions described within this specification.

The memory elements 304 may include one or more physical memory devices such as, for example, local memory 308 and one or more bulk storage devices 310. The local memory may refer to random access memory or other non-persistent memory device(s) generally used during actual execution of the program code. A bulk storage device may be implemented as a hard drive or other persistent data storage device. The processing system 300 may also include one or more cache memories (not shown) that provide temporary storage of at least some program code in order to reduce the quantity of times program code must be retrieved from the bulk storage device 310 during execution. The processing system 300 may also be able to use memory elements of another processing system, e.g. if the processing system 300 is part of a cloud-computing platform.

Input/output (I/O) devices depicted as an input device 312 and an output device 314 optionally can be coupled to the data processing system. Examples of input devices may include, but are not limited to, a keyboard, a pointing device such as a mouse, a microphone (e.g. for voice and/or speech recognition), or the like. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 6 with a dashed line surrounding the input device 312 and the output device 314). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 316 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 300, and a data transmitter for transmitting data from the data processing system 300 to said systems, devices and/or networks. Modems, cable modems, and Ethernet cards are examples of different types of network adapter that may be used with the data processing system 300.

As pictured in FIG. 6, the memory elements 304 may store an application 318. In various embodiments, the application 318 may be stored in the local memory 308, the one or more bulk storage devices 310, or separate from the local memory and the bulk storage devices. It should be appreciated that the data processing system 300 may further execute an operating system (not shown in FIG. 6) that can facilitate execution of the application 318. The application 318, being implemented in the form of executable program code, can be executed by the data processing system 300, e.g., by the processor 302. Responsive to executing the application, the data processing system 300 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 302 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. An electronic device comprising:

at least one processor configured to:

receive a sensor signal from an electromagnetic radiation sensor, determine an orientation of said electromagnetic radiation sensor based on said sensor signal or based on an orientation signal received from an orientation sensor in said electromagnetic radiation sensor, transmit said sensor signal t a first device or application of a plurality of devices or applications when said electromagnetic radiation sensor is oriented in a first orientation, and transmit said sensor signal to a second device or application of said plurality of devices or applications when said electromagnetic radiation sensor is oriented in a second orientation.

2. The electronic device as claimed in claim 1, wherein said first device or application is a lighting control device or application and said second device or application is a device or application different from said lighting control device or application of said first device or application.

3. The electronic device as claimed in claim 2, wherein said first device or application is a node in a lighting network and said second device or application is configured to render on-screen information in dependence on said sensor signal.

4. The electronic device as claimed in claim 2, wherein said second device or application is configured to cause a speaker and/or a display to render textual information.

5. The electronic device as claimed in claim 2, wherein said second device or application is configured to perform at least one of: sleep monitoring, baby monitoring, security monitoring, people counting, pet monitoring, and health monitoring.

6. The electronic device as claimed in claim 1, wherein said at least one processor is configured to determine a user identity and transmit said sensor signal to one of said plurality of devices or applications further in dependence on said user identity.

7. The electronic device as claimed in claim 1, further comprising said electromagnetic radiation sensor.

8. The electronic device as claimed in claim 7, wherein said electronic device has a plurality of support surfaces, said orientation indicating on which of said plurality of support surfaces said sensor device is resting.

9. The electronic device as claimed in claim 1, wherein said at least one processor is configured to receive said sensor signal from a sensor device.

10. A system comprising the electronic device of claim 9 and said sensor device, said sensor device having a plurality of support surfaces, said orientation indicating on which of said plurality of support surfaces said sensor device is resting.

11. A method of transmitting a sensor signal, comprising:

receiving a sensor signal from an electromagnetic radiation sensor;

determining an orientation of said electromagnetic radiation sensor based on said sensor signal or based on an orientation signal received from an orientation sensor in said electromagnetic radiation sensor; and transmitting said sensor signal to a first device or application of a plurality of devices or applications when said electromagnetic radiation sensor is oriented in a first orientation; and transmitting said sensor signal to a second device or application of said plurality of devices or applications when said electromagnetic radiation sensor is oriented in a second orientation.

12. A non-transitory computer-readable medium for a computing device, comprising computer program code configured to perform the method of claim 11 when the computer program code is run on a processing unit of the computing device.

* * * * *